US007005572B2

(12) United States Patent
Fay

(10) Patent No.: US 7,005,572 B2
(45) **Date of Patent: *Feb. 28, 2006**

(54) DYNAMIC CHANNEL ALLOCATION IN A SYNTHESIZER COMPONENT

(75) Inventor: Todor J. Fay, Bellevue, WA (US)

(73) Assignee: Microsoft Corporation, Redmond, WA (US)

( * ) Notice: Subject to any disclaimer, the term of this patent is extended or adjusted under 35 U.S.C. 154(b) by 66 days.

This patent is subject to a terminal disclaimer.

(21) Appl. No.: 10/974,189

(22) Filed: Oct. 27, 2004

(65) Prior Publication Data

US 2005/0056143 A1 Mar. 17, 2005

Related U.S. Application Data

(63) Continuation of application No. 09/802,323, filed on Mar. 7, 2001, now Pat. No. 6,806,412.

(51) Int. Cl.
*G10H 7/00* (2006.01)

(52) U.S. Cl. ..... 84/645

(58) Field of Classification Search ..... 84/609, 84/610, 645, 649–650, 477 R, 478
See application file for complete search history.

(56) References Cited

U.S. PATENT DOCUMENTS 5,142,961 A 9/1992 Paroutaud
5,303,218 A 4/1994 Miyake
5,315,057 A 5/1994 Land et al.
5,511,002 A 4/1996 Milne et al.
5,548,759 A 8/1996 Lipe
5,717,154 A 2/1998 Gulick
5,734,119 A 3/1998 France et al.
5,761,684 A 6/1998 Gibson
5,792,971 A 8/1998 Timis et al.
5,842,014 A 11/1998 Brooks et al.
5,852,251 A 12/1998 Su et al.
5,890,017 A 3/1999 Tulkoff et al.
5,902,947 A 5/1999 Burton et al.
5,942,707 A 8/1999 Tamura
5,977,471 A 11/1999 Rosenzweig
6,100,461 A 8/2000 Hewitt
6,152,856 A 11/2000 Studor et al.
6,169,242 B1 1/2001 Fay et al.
6,173,317 B1 1/2001 Chaddha et al.
6,175,070 B1 1/2001 Naples et al.
6,216,149 B1 4/2001 Conner et al.
6,225,546 B1 5/2001 Kraft et al.
6,357,039 B1 3/2002 Kuper
6,433,266 B1 8/2002 Fay et al.

(Continued)

OTHER PUBLICATIONS

Malham et al.,"3-D Sound Spatialization using Ambisonic Techniques" Computer Music Journal Winter 1995 vol. 19 No. 4 pp. 58-70.

(Continued)

*Primary Examiner*—Jeffrey W Donels
(74) *Attorney, Agent, or Firm*—Lee & Hayes, PLLC

(57) ABSTRACT

An audio generation system receives audio instructions that have instruction channel designations and dynamically allocates synthesizer channels in groups of sixteen channels that support the MIDI standard to receive the audio instructions. The synthesizer channels are assigned to receive the audio instructions such that audio instructions having the same instruction channel designations are assigned to be received by synthesizer channels in different synthesizer channel groups. The audio instructions are routed to the synthesizer channels in accordance with the instruction channel designations of the audio instructions and the synthesizer channel assignments via mapping channels in a mapping component, where an individual mapping channel corresponds to a particular synthesizer channel.

53 Claims, 7 Drawing Sheets

U.S. PATENT DOCUMENTS

| | | | |
|---|---|---|---|
| 6,541,689 | B1 | 4/2003 | Fay et al. |
| 6,658,309 | B1 | 12/2003 | Abrams et al. |
| 2002/0108484 | A1 | 8/2002 | Arnold et al. |

OTHER PUBLICATIONS

Stanojevic et al., "The Total Surround Sound (TSS) Processor" SMPTE Journal Nov. 1994 vol. 3 No. 11 pp. 734-740.
Berry M., "An Introduction to GrainWave" Computer Music Journal Spring 1999 vol. 23 No. 1 pp. 57-61.
Meyer D., "Signal Processing Architecture for Loudspeaker Array Directivity Control" ICASSP Mar. 1985 vol. 2 pp. 16.7.1-16.7.4.
Reilly et al. ,"Interactive DSP Debugging in the Multi-Processor Huron Environment" ISSPA Aug. 1996 pp. 270-273.
Cohen et al., "Multidimensional Audio Window Management" Int. J. Man-Machine Studies 1991 vol. 34 No. 3 pp. 319-336.
Nieberle et al. ,"CAMP: Computer-Aided Music Processing" Computer Music Journal Summer 1991 vol. 15 No. 2 pp. 33-40.
Camurri et al.,"A Software Architecture for Sound and Music Processing" Microprocessing and Microprogramming Sep. 1992 vol. 35 pp. 625-632.
Dannenberg et al.,"Real-Time Software Synthesis on Superscalar Architectures" Computer Music Journal Fall 1997 vol. 21 No. 3 pp. 83-94.
Meeks H. ,"Sound Forge Version 4.0b" Social Science Computer Review Summer 1998 vol. 16 No. 2 pp. 205-211.
Ulianich V. ,"Project FORMUS: Sonoric Space-time and the Artistic Synthesis of Sound" Leonardo 1995 vol. 28 No. 1 pp. 63-66.
Piche et al.,"Cecilia: A Production Interface to Csound", Computer Music Journal, Summer 1998, vol. 22, No. 2, pp. 52-55.
Harris et al.; "The Application of Embedded Transputers in a Professional Digital Audio Mixing System"; IEEE Colloquium on "Transputer Applications"; Digest No. 129, 2/1-3 (uk Nov. 13, 1989).
Moorer, James; "The Lucasfilm Audio Signal Processor"; Computer Music Journal, vol. 6, No. 3, Fall 1982, 0148-9267/82/030022-11; pp. 22 through 32.
Vercoe, Barry; "New Dimensions in Computer Music"; Trends & Perspectives in Signal Processing; Focus, Apr. 1982; pp. 15 through 23.
Vercoe, et al; "Real-Time CSOUND: Software Synthesis with Sensing and Control"; ICMC Glasgow 1990 for the Computer Music Association; pp. 209 through 211.
Waid, Fred; "APL and the Media"; Proceedings of the Tenth APL as a Tool of Thought Conference; held at Stevens Institute of Technology, Hoboken, New Jersey, Jan. 31, 1998, pp. 111 through 122.
Wippler, Jean-Claude; "Scripted Documents"; Proceedings of the 7th USENIX Tcl/TKConference; Austin Texas; Feb. 14-18, 2000; The USENIX Association.
Miller, et al; "Audio-Enhanced Computer Assisted Learning and Computer Controlled Audio-Instruction"; Comput. Educ. vol. 7, pp. 33-54, (1983) Pergamon Press Ltd., Great Britain.

Background

DYNAMIC CHANNEL ALLOCATION IN A SYNTHESIZER COMPONENT

RELATED APPLICATIONS

This application is a continuation of U.S. patent application Ser. No. 09/802,323 entitled "Dynamic Channel Allocation in a Synthesizer Component" filed Mar. 7, 2001 U.S. Pat. No. 6,806,412, to Fay, and claims priority to each of (1) U.S. patent application Ser. No. 09/802,323, and to copending applications (2) U.S. patent application Ser. No. 09/801,922 entitled "Audio Generation System Manager" filed Mar. 7, 2001, to Fay et al.; (3) U.S. patent application Ser. No. 09/802,111 entitled "Synthesizer Multi-Bus Component" filed Mar. 7, 2001, to Fay et al.; and (4) U.S. patent application Ser. No. 09/801,938 entitled "Accessing Audio Processing Components in an Audio Generation System", filed Mar. 7, 2001, to Fay et al., the disclosures of which are all incorporated by reference herein.

TECHNICAL FIELD

This invention relates to audio processing and, in particular, to dynamic channel allocation in a synthesizer component.

BACKGROUND

Multimedia programs present data to a user through both audio and video events while a user interacts with a program via a keyboard, joystick, or other interactive input device. A user associates elements and occurrences of a video presentation with the associated audio representation. A common implementation is to associate audio with movement of characters or objects in a video game. When a new character or object appears, the audio associated with that entity is incorporated into the overall presentation for a more dynamic representation of the video presentation.

Audio representation is an essential component of electronic and multimedia products such as computer based and stand-alone video games, computer-based slide show presentations, computer animation, and other similar products and applications. As a result, audio generating devices and components are integrated with electronic and multimedia products for composing and providing graphically associated audio representations. These audio representations can be dynamically generated and varied in response to various input parameters, real-time events, and conditions. Thus, a user can experience the sensation of live audio or musical accompaniment with a multimedia experience.

Conventionally, computer audio is produced in one of two fundamentally different ways. One way is to reproduce an audio waveform from a digital sample of an audio source which is typically stored in a wave file (i.e., a .wav file). A digital sample can reproduce any sound, and the output is very similar on all sound cards, or similar computer audio rendering devices. However, a file of digital samples consumes a substantial amount of memory and resources for streaming the audio content. As a result, the variety of audio samples that can be provided using this approach is limited. Another disadvantage of this approach is that the stored digital samples cannot be easily varied.

Another way to produce computer audio is to synthesize musical instrument sounds, typically in response to instructions in a Musical Instrument Digital Interface (MIDI) file. MIDI is a protocol for recording and playing back music and audio on digital synthesizers incorporated with computer sound cards. Rather than representing musical sound directly, MIDI transmits information and instructions about how music is produced. The MIDI command set includes note-on, note-off, key velocity, pitch bend, and other methods of controlling a synthesizer.

The audio sound waves produced with a synthesizer are those already stored in a wavetable in the receiving instrument or sound card. A wavetable is a table of stored sound waves that are digitized samples of actual recorded sound. A wavetable can be stored in read-only memory (ROM) on a sound card chip, or provided with software. Prestoring sound waveforms in a lookup table improves rendered audio quality and throughput. An advantage of MIDI files is that they are compact and require few audio streaming resources, but the output is limited to the number of instruments available in the designated General MIDI set and in the synthesizer, and may sound very different on different computer systems.

MIDI instructions sent from one device to another indicate actions to be taken by the controlled device, such as identifying a musical instrument (e.g., piano, flute, drums, etc.) for music generation, turning on a note, and/or altering a parameter in order to generate or control a sound. In this way, MIDI instructions control the generation of sound by remote instruments without the MIDI control instructions carrying sound or digitized information. A MIDI sequencer stores, edits, and coordinates the MIDI information and instructions. A synthesizer connected to a sequencer generates audio based on the MIDI information and instructions received from the sequencer. Many sounds and sound effects are a combination of multiple simple sounds generated in response to the MIDI instructions.

A MIDI system allows audio and music to be represented with only a few digital samples rather than converting an analog signal to many digital samples. The MIDI standard supports different channels that can each simultaneously provide an output of audio sound wave data. There are sixteen defined MIDI channels, meaning that no more than sixteen instruments can be playing at one time. Typically, the command input for each channel represents the notes corresponding to an instrument. However, MIDI instructions can program a channel to be a particular instrument. Once programmed, the note instructions for a channel will be played or recorded as the instrument for which the channel has been programmed. During a particular piece of music, a channel can be dynamically reprogrammed to be a different instrument.

A Downloadable Sounds (DLS) standard published by the MIDI Manufacturers Association allows wavetable synthesis to be based on digital samples of audio content provided at run time rather than stored in memory. The data describing an instrument can be downloaded to a synthesizer and then played like any other MIDI instrument. Because DLS data can be distributed as part of an application, developers can be sure that the audio content will be delivered uniformly on all computer systems. Moreover, developers are not limited in their choice of instruments.

A DLS instrument is created from one or more digital samples, typically representing single pitches, which are then modified by a synthesizer to create other pitches. Multiple samples are used to make an instrument sound realistic over a wide range of pitches. DLS instruments respond to MIDI instructions and commands just like other MIDI instruments. However, a DLS instrument does not have to belong to the General MIDI set or represent a musical instrument at all. Any sound, such as a fragment of speech or a fully composed measure of music, can be associated with a DLS instrument.

Conventional Audio and Music System

FIG. 1 illustrates a conventional audio and music generation system 100 that includes a synthesizer 102 and two MIDI inputs 104 and 106. Typically, a synthesizer is implemented in computer software, in hardware as part of a computer's internal sound card, or as an external device such as a MIDI keyboard or module. Conventionally, a synthesizer 102 receives MIDI inputs on sixteen channels 108 (1–16) that conform to the MIDI standard. The inputs are in the form of individual instructions, each of which designates the channel to which it applies. Within the synthesizer 102, instructions associated with different channels are processed in different ways, depending on the programming for the various channels.

A MIDI instruction, such as a "note-on", directs a synthesizer 102 to play a particular note, or notes, on a synthesizer channel 108 having a designated instrument. The General MIDI standard defines standard sounds that can be combined and mapped into the sixteen separate instrument and sound channels. A MIDI event on a synthesizer channel corresponds to a particular sound and can represent a keyboard key stroke, for example. The "note-on" MIDI instruction can be generated with a keyboard when a key is pressed and the "note-on" instruction is sent to synthesizer 102. When the key on the keyboard is released, a corresponding "note-off" instruction is sent to stop the generation of the sound corresponding to the keyboard key.

A MIDI input is typically a serial data stream that is parsed in the synthesizer into MIDI commands and synthesizer control information. A MIDI command or instruction is represented as a data structure containing information about the sound effect or music piece such as the pitch, relative volume, duration, and the like. The output of a synthesizer channel 108 is a sound waveform that is mixed and input to a buffer (not shown). A buffer in this instance is typically an allocated area of memory that temporarily holds sequential samples of audio wave data that will be subsequently delivered to a sound card or similar audio rendering device to produce audible sound.

The MIDI input 104 has a sound effect instruction 110 to generate a dog bark sound on MIDI channel 1 in synthesizer 102. The MIDI input 106 is a music piece having instructions 112(1–3) to generate musical instrument sounds. Instruction 112(1) designates that a flute sound be generated on MIDI channel 1, instruction 112(2) designates that a horn sound be generated on MIDI channel 2, and instruction 112(3) designates that drums be generated on MIDI channel 10 in synthesizer 102.

The MIDI channel assignments are designated when the MIDI inputs 104 and 106 are authored, or created. The limited number of available MIDI channels in a synthesizer results in the problem of one input overriding and canceling out another input, or the problem of overlapping content when playing back the designated sounds of MIDI inputs. For example, channel 108(1) in synthesizer 102 receives two inputs at the same time—instruction 110 to generate the dog bark sound effect and instruction 112(1) to generate a flute sound. The synthesizer 102 might first receive the flute instruction 112(1), then the dog bark instruction 110 which overrides the first input, and then an associated flute instruction to play a particular note. The undesirable output is a flute note that is played as a dog bark.

A conventional software synthesizer that translates MIDI instructions into audio signals does not support distinctly separate sets of MIDI channels. The number of sounds that can be played simultaneously is limited by the number of channels and resources available in the synthesizer. In the event that there are more MIDI inputs than there are available channels and resources, one or more inputs are suppressed by the synthesizer.

Another problem with having only a limited number of synthesizer channels is that content intended to be played multiple times for the same sound effect, such as two dogs barking, cannot be faded one over the other. A pre-authored dog bark sound effect is assigned to a designated MIDI channel, as with input 104, for example. Rather than being able to play two distinct dog barks from the same source at or near the same time, two instances of the sound effect will be input to synthesizer channel 1 and only one dog bark will be rendered as audible sound at one time. This also precludes initiating two of the same sound effect and fading one over the other.

SUMMARY

An audio generation system receives audio instructions that have instruction channel designations. The audio instructions are formatted as MIDI instructions and have MIDI channel designations that designate MIDI channels from the pre-defined range of sixteen MIDI channels.

A synthesizer component has dynamically allocated synthesizer channels that receive the audio instructions. The synthesizer channels are allocated in channel groups of sixteen channels that support the MIDI standard. The synthesizer channels are assigned to receive the audio instructions such that audio instructions having the same instruction channel designation are assigned to be received by synthesizer channels in different synthesizer channel groups.

A mapping component has dynamically allocated channel blocks that correspond to the synthesizer channel groups, and the channel blocks each have sixteen mapping channels that also support the MIDI standard. A mapping channel in a channel block corresponds to a synthesizer channel in the synthesizer channel group that corresponds to the mapping component channel block.

The audio instructions are routed to the synthesizer channels in accordance with the instruction channel designations of the audio instructions and the synthesizer channel assignments. Audio instructions are routed to a synthesizer channel via the corresponding mapping channel in the mapping component.

BRIEF DESCRIPTION OF THE DRAWINGS

The same numbers are used throughout the drawings to reference like features and components.

DETAILED DESCRIPTION

The following describes systems and methods to receive and independently process MIDI inputs in a synthesizer when more than one of the inputs designate the same synthesizer channel, or when more than the standard sixteen MIDI channels are needed to receive multiple MIDI inputs. Groups of sixteen synthesizer channels are dynamically allocated as needed to avoid overlapping channel inputs.

Exemplary Audio Generation System

Figure 1:
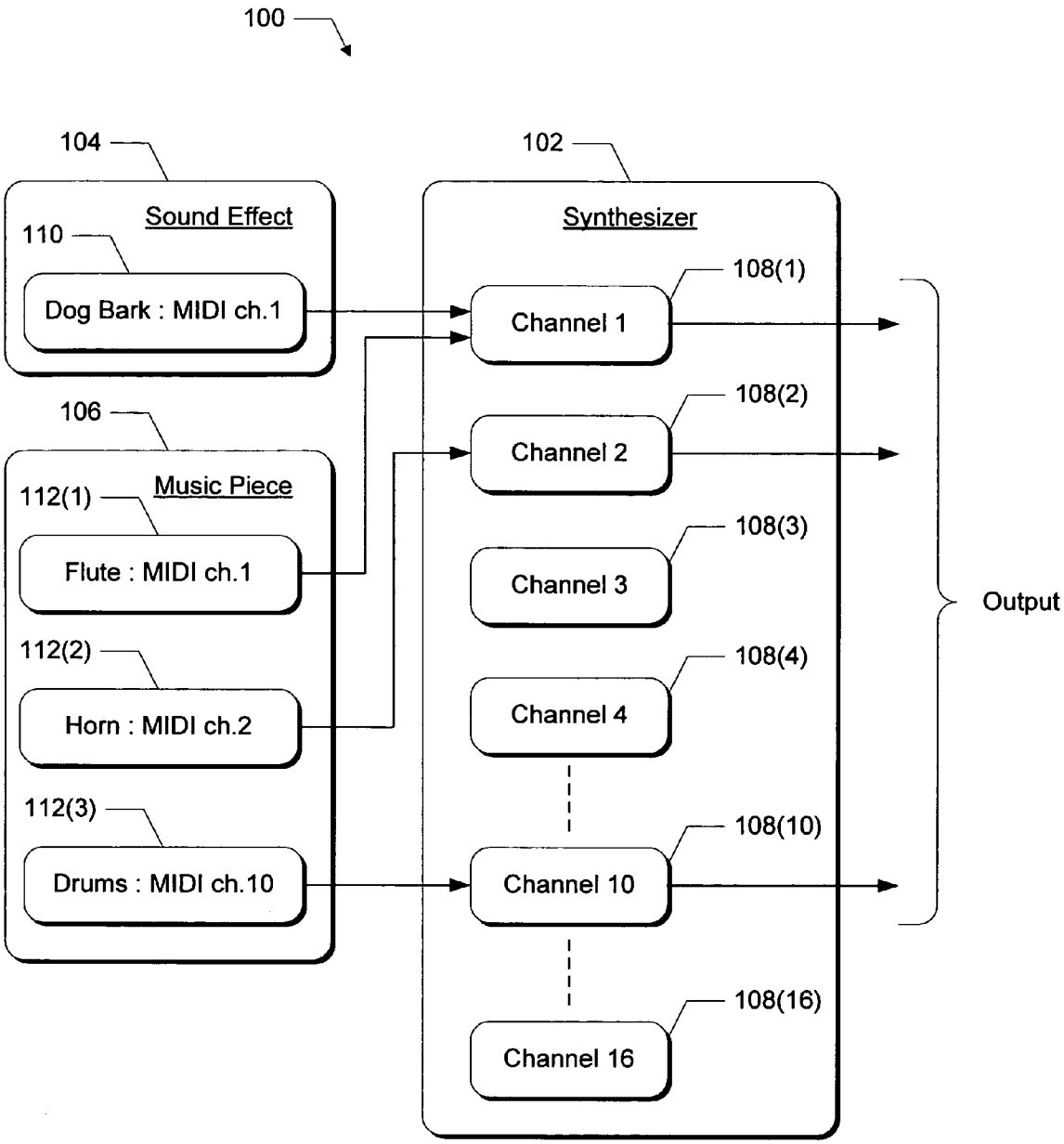
FIG. 1 is a block diagram that illustrates a conventional audio and music generation system.
Figure 2:
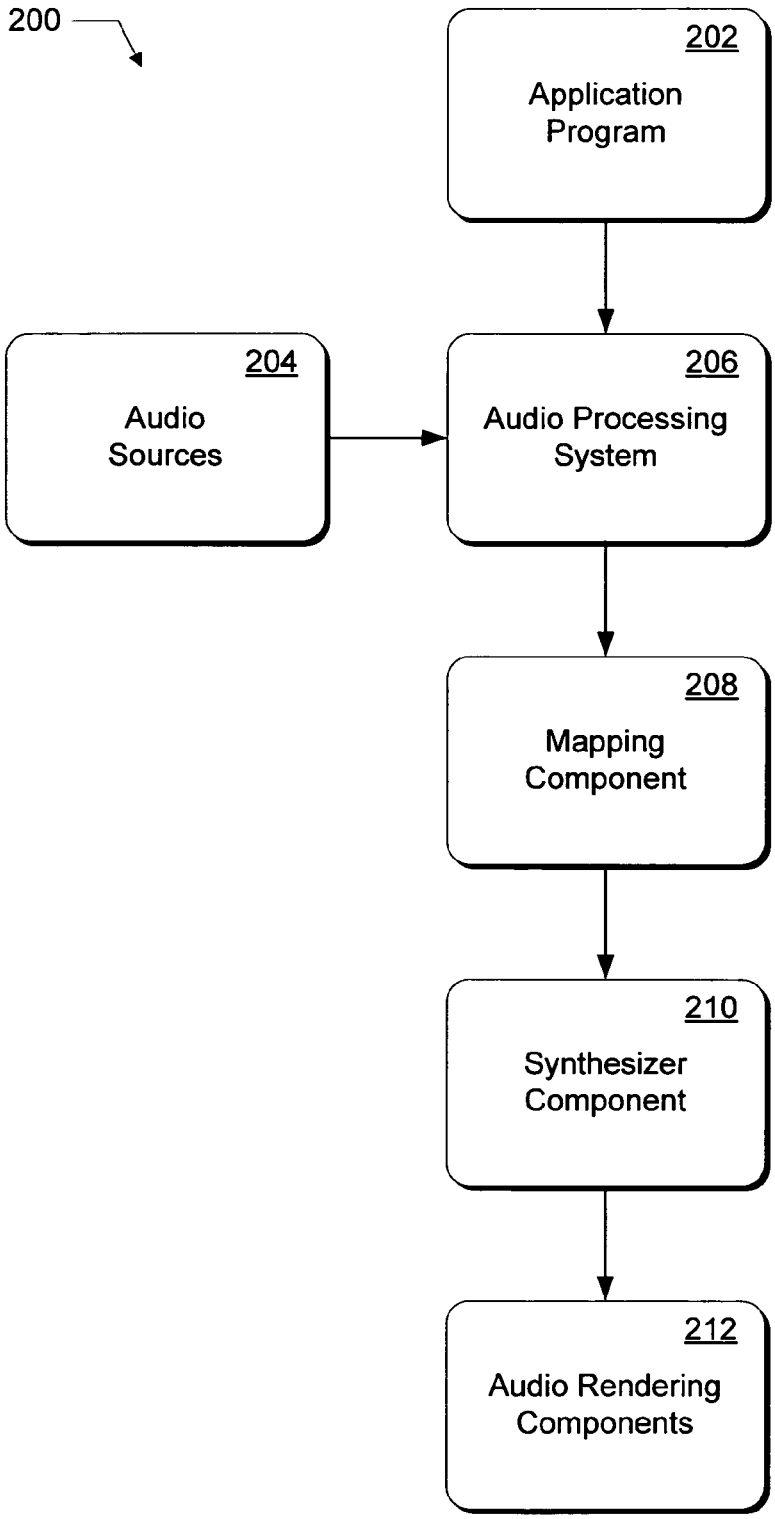
FIG. 2 is a block diagram that illustrates components of an audio generation system.

FIG. 2 illustrates an audio generation system 200 having components that can be implemented within a computing device, or the components can be distributed within a computing system having more than one computing device. The audio generation system 200 generates audio events that are processed and rendered by separate audio processing components of a computing device or system. See the description of "Exemplary Computing System and Environment" below for specific examples and implementations of network and computing systems, computing devices, and components that can be utilized to facilitate the implementation of the technology described herein.

Audio generation system 200 includes an application program 202, audio sources 204, and an audio processing system 206. Application program 202 is one of a variety of different types of applications, such as a video game program, some other type of entertainment program, or an application that incorporates an audio representation with a video presentation.

Audio sources 204 provide digital samples of audio data such as from a wave file (i.e., a .wav file), message-based data such as from a MIDI file or a pre-authored segment file, or an audio sample such as a Downloadable Sound (DLS). Although not shown, the audio sources 204 can be stored and incorporated in the application program 202 as a resource rather than in a separate file.

Application program 202 initiates that an audio source 204 provide input to the audio processing system 206. The application program 202 interfaces with the audio processing system 206 and the other components of the audio generation system 200 via application programming interfaces (APIs). The various components described herein are implemented using standard programming techniques, including the use of OLE (object linking and embedding) and COM (component object model) interfaces. COM objects are implemented in a system memory of a computing device, each object having one or more interfaces, and each interface having one or more methods. The interfaces and interface methods can be called by application programs and by other objects. The interface methods of the objects are executed by a processing unit of the computing device. Familiarity with object-based programming, and with COM objects in particular, is assumed throughout this disclosure. However, those skilled in the art will recognize that the audio generation systems and the various components described herein are not limited to a COM and/or OLE implementation, or to any other specific programming technique.

The audio generation system 200 also includes a mapping component 208, a synthesizer component 210, and audio rendering components 212. The audio processing system 206 produces audio instructions for input to the audio generation system components. For example, the audio processing system produces MIDI instructions that are formatted for input to synthesizer component 210. Additional information regarding the audio data processing components described herein can be found in the concurrently-filed U.S. Patent Application entitled "Audio Generation System Manager", which is incorporated by reference above. However, any audio processing system can be used to produce audio instructions for input to the audio generation system components.

Mapping component 208 maps MIDI instructions from the audio processing system 206 to the synthesizer component 210. The mapping component can be implemented in hardware or software, and although not shown, can be integrated with the audio processing system 206. The mapping component allows MIDI instructions from multiple sources (e.g., multiple audio sources 204, or multiple audio processing systems 206) to be input to one or more synthesizer components 210.

Synthesizer component 210 receives MIDI instructions from audio processing system 206 via the mapping component 208. The synthesizer component 210 can also use the sampling technologies described, or algorithmic technologies such as FM or physical modeling synthesis. The form of the input source to synthesizer component 210 does not limit the scope of dynamic synthesizer channel allocation. The synthesizer component 210 generates sound waveforms from stored wavetable data in accordance with the received MIDI instructions. The sound waveforms are input to the audio rendering components 212 which are hardware and/or software components, such as a speaker or soundcard, that renders audio from the audio sound wave data. Additional information regarding the audio data processing components described herein can be found in the concurrently-filed U.S. Patent Application entitled "Synthesizer Multi-Bus Component", which is incorporated by reference above.

Exemplary Synthesizer and Mapping Component

Figure 3:
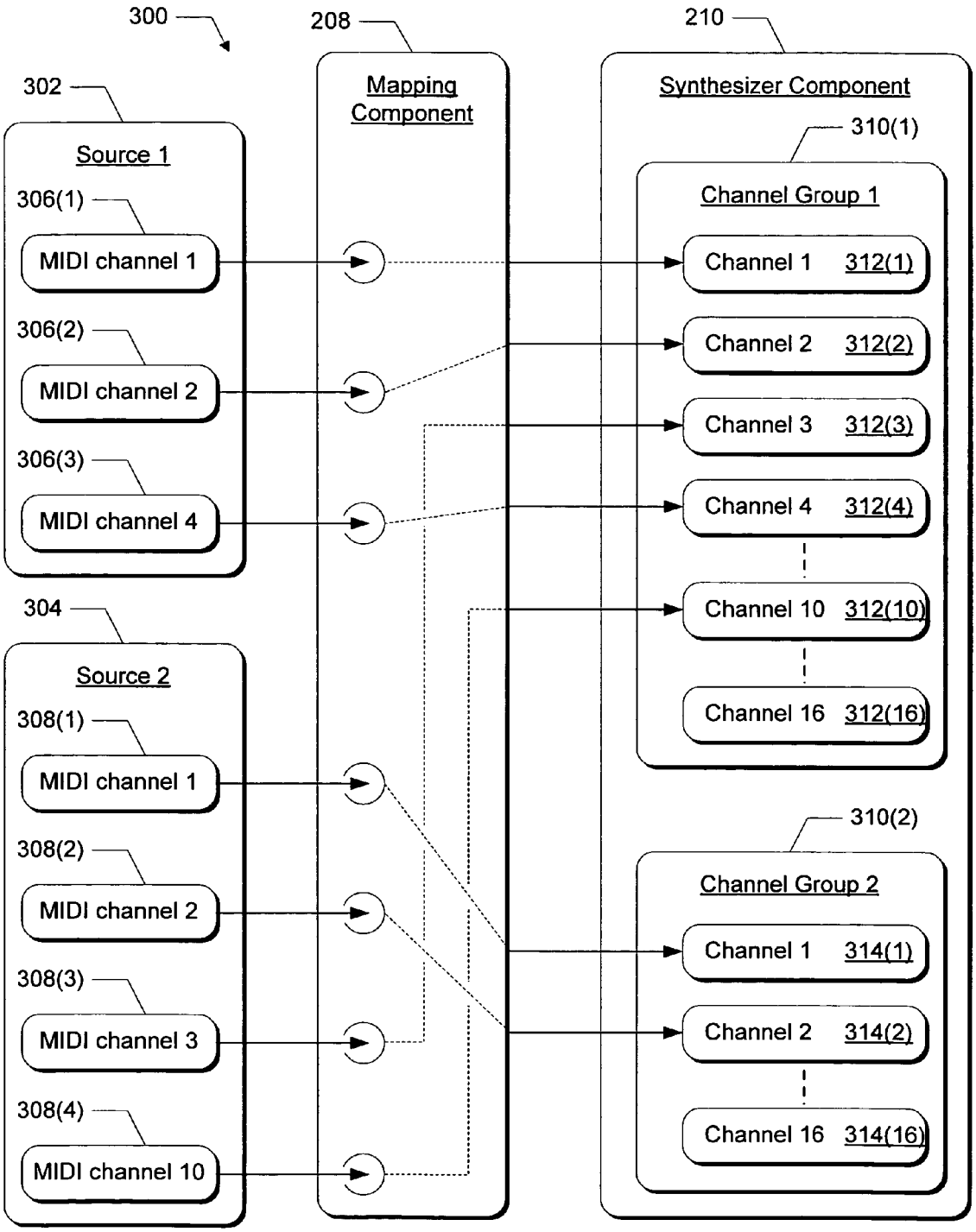
FIG. 3 is a block diagram that further illustrates components of the audio generation system shown in FIG. 2.

FIG. 3 illustrates a mapping component 208 and a synthesizer component 210 in accordance with an implementation of the audio generation system described herein. Additionally, FIG. 3 illustrates two MIDI inputs 302 and 304 from two sources. MIDI input 302 from the first source has audio instructions 306(1–3) that designate MIDI channels 1, 2, and 4, respectively. MIDI input 304 from the second source has audio instructions 308(1–4) that designate MIDI channels 1, 2, 3, and 10 respectively. Mapping component 208 routes the audio instructions 306(1–3) and 308(1–4) to the synthesizer component 210. The routing aspects of the mapping component 208 are described below with reference to FIG. 4.

Synthesizer component 210 has two channel groups 310 (1) and 310(2), each having sixteen MIDI channels 312 (1–16) and 314(1–16), respectively. Those skilled in the art will recognize that a group of sixteen MIDI channels can be identified as channels zero through fifteen (0–15). For consistency and explanation clarity, groups of sixteen MIDI channels described herein are designated one through sixteen (1–16).

To support the MIDI standard, and at the same time make more MIDI channels available in a synthesizer 210 to receive MIDI inputs, channel groups 310 are dynamically created as needed. Up to 65,536 channel groups, each containing sixteen channels, can be created and can exist at any one time for a total of over one million channels in a synthesizer component 210. The MIDI channels are dynamically allocated for one or more synthesizers to receive multiple inputs. The multiple inputs can then be processed at the same time without channel overlapping and without channel clashing.

The two sources in FIG. 3, MIDI inputs 302 and 304, have MIDI channel designations that designate the same MIDI channel. For example, both sources have audio instructions 306(1–2) and 308(1–2) that designate MIDI channels 1 and 2. When the mapping component 208 receives audio instructions from one or more sources that designate the same MIDI channel, the audio instructions are routed to a synthesizer channel 312 or 314 in different channel groups 310(1) or 310(2), respectively.

In this instance, mapping component 208 receives the audio instructions 306 from the first source, MIDI input 302, and routes the audio instructions to synthesizer channels 312 in the first channel group 310(1). That is, audio instruction 306(1) which designates MIDI channel 1 is routed to synthesizer channel 312(1), audio instruction 306(2) which designates MIDI channel 2 is routed to synthesizer channel 312(2), and audio instruction 306(3) which designates MIDI channel 4 is routed to synthesizer channel 312(4).

When the mapping component 208 receives the audio instructions 308 from the second source, MIDI input 304, the mapping component routes the audio instructions to synthesizer channels 312 in the first channel group 310(1) that are not currently in use, and to synthesizer channels 314 in the second channel group 310(2). That is, audio instruction 308(1) which designates MIDI channel 1 is routed to synthesizer channel 314(1) in the second channel group 310(2) because the first MIDI channel 312(1) in the first channel group 310(1) already has an input from the first source audio instruction 306(1). Similarly, audio instruction 308(2) which designates MIDI channel 2 is routed to synthesizer channel 314(2) in the second channel group 310(2).

The mapping component 208 routes audio instruction 308(3) from the second source, which designates MIDI channel 3, to synthesizer channel 312(3) in the first channel group 310(1) because the channel is available and not currently in use. Similarly, audio instruction 308(4) which designates MIDI channel 10 is routed to synthesizer channel 312(10) in the first channel group 310(1).

Figure 4:
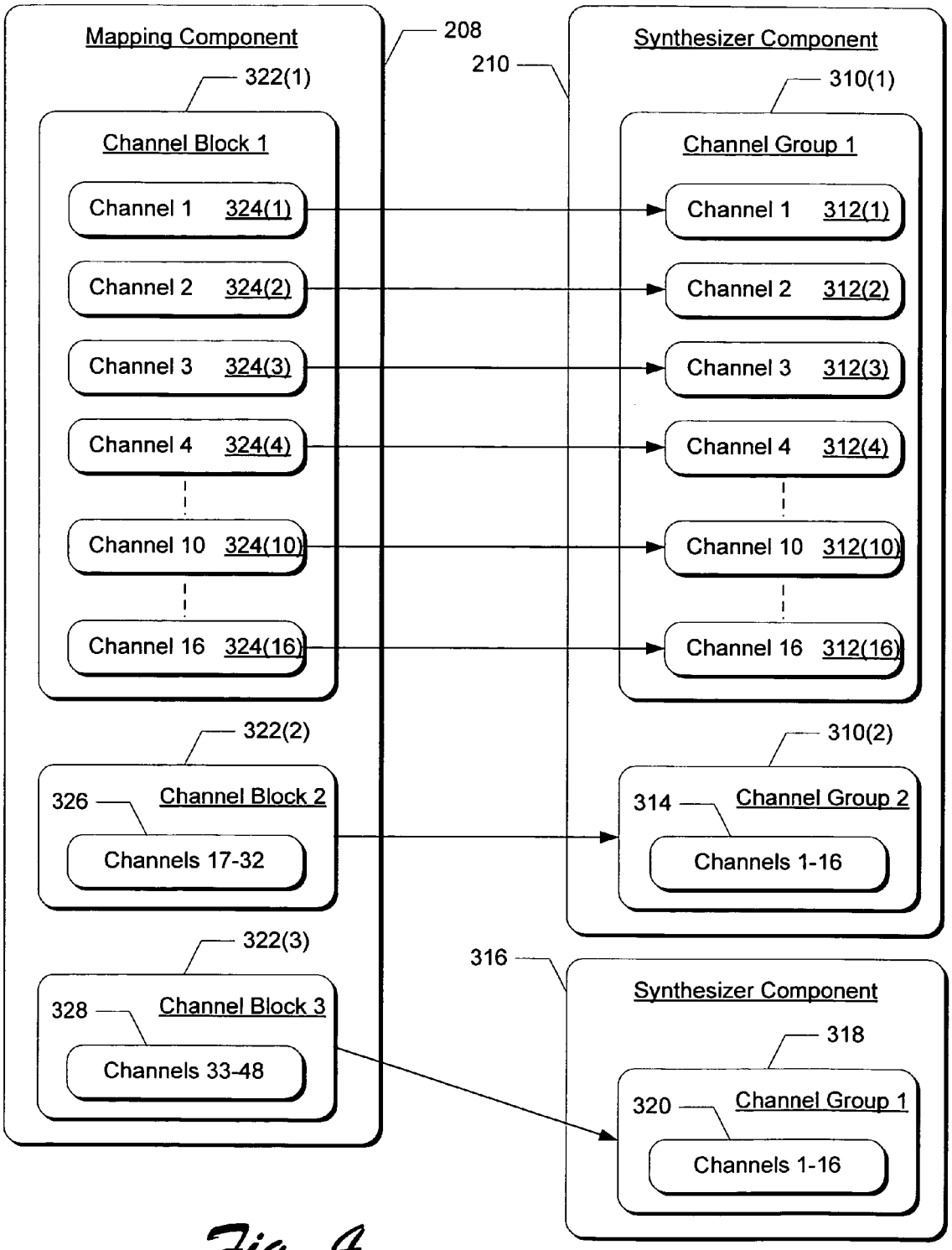
FIG. 4 is a block diagram that further illustrates components of the audio generation system shown in FIG. 2.

FIG. 4 illustrates details of mapping component 208, a first synthesizer component 210, and a second synthesizer component 316 in accordance with an implementation of the invention described herein. As described above with respect to FIG. 3, synthesizer component 210 has two channel groups 310(1) and 310(2) each having sixteen MIDI channels 312(1–16) and 314(1–16), respectively. The second synthesizer component 316 has a channel group 318 which also has sixteen MIDI channels 320. Although shown as a single component, the MIDI channels 320 in the second synthesizer component 316, and the MIDI channels 314 in the first synthesizer component 210, are individual synthesizer channels within the respective channel groups, such as illustrated in the first channel group 310(1) in synthesizer component 210.

The mapping component 208 has three channel blocks 322(1–3), each having sixteen audio instruction channels that are mapping channels to receive audio instructions from input sources and route the audio instructions to the synthesizer components 210 and 316. The first channel block 322(1) has channels 324(1–16), the second channel block 322(2) has channels 326(17–32), and the third channel block 322(3) has channels 328(33–48). The channel blocks 322 are dynamically created as needed to receive audio instructions from input sources. The channel blocks each have sixteen channels to support the MIDI standard and the channels are identified sequentially. For example, the first channel block 322(1) has channels 1–16, the second channel block 322(2) has channels 17–32, and the third channel block 322(3) has channels 33–48.

Each channel block 322 corresponds to a synthesizer channel group, and each mapping channel in a channel block maps directly to a synthesizer channel in the synthesizer channel group. For example, the first channel block 322(1) corresponds to the first channel group 310(1) in synthesizer component 210. Each mapping channel 324(1–16) in the first channel block 322(1) corresponds to each of the sixteen synthesizer channels 312(1–16) in channel group 310(1). Additionally, channel block 322(2) corresponds to the second channel group 310(2) in the first synthesizer component 210, and each mapping channel 326(17–32) corresponds to synthesizer channels 314(1–16). Channel block 322(3) corresponds to the first channel group 318 in the second synthesizer component 316, and each mapping channel 328(33–48) corresponds to synthesizer channels 320(1–16), respectively.

Figure 5:
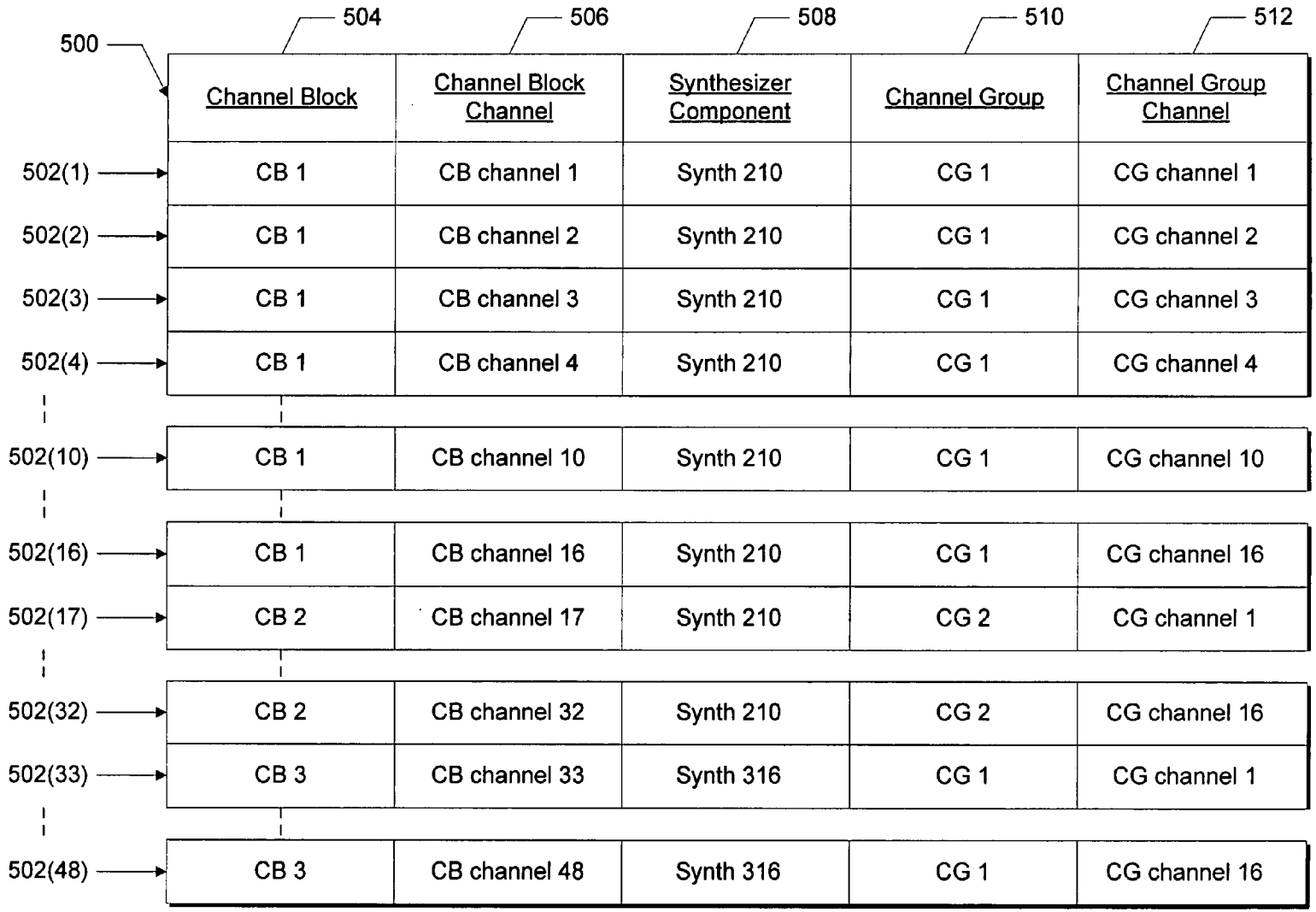
FIG. 5 is a block diagram of a data structure that correlates the components illustrated in FIG. 4.

FIG. 5 illustrates a mapping list 500 that is a data structure maintained by the computing device that implements the mapping component 208. The mapping list 500 is a mapping channel block-to-synthesizer channel group mapping list having a plurality of mappings 502(1–n). Each mapping 502 has a associates a mapping component channel block with a particular synthesizer channel group, and mapping channels with particular synthesizer channels.

For example, the first mapping 502(1) associates the first channel block 322(1) (FIG. 4) of mapping component 208, and the first mapping channel 324(1) of the first channel block 322(1), with the first synthesizer component 210, the first channel group 310(1) in synthesizer 210, and the first synthesizer channel 312(1) in the first channel group 310(1). Those skilled in the art will recognize that various techniques are available to implement the mapping list 500 as a data structure.

Mapping component 208 allows multiple sources to share available synthesizer channels, and dynamically allocating synthesizer channels allows multiple source inputs at any one time. For example, the first source, MIDI input 302 (FIG. 3), only designates three MIDI channels 1, 2, and 4 in the audio instructions 306(1–3). These are mapped to the first channel group 310(1) in the first synthesizer component 210 via the first channel block 322(1) in mapping component 208. When the second source, MIDI input 304, is received, the mapping component 208 recognizes that only three of the sixteen mapping channels 324 in the first channel block 322(1) are in use. Thus, the mapping component also maps audio instructions 308(3) and 308(4), which designate MIDI channels 3 and 10, respectively, to the first channel group 310(1) in the first synthesizer component 210 via the first channel block 322(1).

When particular synthesizer channels are no longer needed to receive MIDI inputs, the resources allocated to create the synthesizer channels are released as well as the channel group containing the synthesizer channels. Similarly, when unused synthesizer channels are released, the resources allocated to create the channel block corresponding to the synthesizer channel group are released to conserve resources.

Mapping component 208 can allocate a channel block with a broadcast channel to designate that all audio instructions received from a particular source will be processed together according to the broadcast channel instruction. For example, mapping channel 324(1) in the first channel block 322(1) can be designated as a broadcast channel having a volume fade instruction that will auto-fade the volume of every instruction received on the mapping channels 324 (1–16) in channel block 322(1). Additionally, an audio instruction can be received at the mapping component 208 that designates that all audio channels associated with a particular source be processed according to the broadcast channel instruction. That is, all of the mapping channels in all of the channel blocks will be processed with the same instruction.

File Format and Component Instantiation

The mapping component 208 and a synthesizer component, such as synthesizer 210, can be implemented as a programming object. Configuration information for mapping component 208 and synthesizer component 210 is stored in a file format such as the Resource Interchange File Format (RIFF). A RIFF file includes a file header that contains data describing the object followed by what are known as "chunks." Each of the chunks following a file header corresponds to a data item that describes the object, and each chunk consists of a chunk header followed by actual chunk data. A chunk header specifies an object class identifier (CLSID) that can be used for creating an instance of the object. Chunk data consists of the data to define the corresponding data item.

A RIFF file for the mapping component 208 and synthesizer component 210 has configuration information that includes identifying the synthesizer technology designated by source input audio instructions. An audio source can be designed to play on more than one synthesis technology. For example, a hardware synthesizer can be designated by some audio instructions from a particular source, for performing certain musical instruments for example, while a wavetable synthesizer in software can be designated by the remaining audio instructions for the source.

The configuration information also includes identifying whether a synthesizer channel 10 will be designated as a drums channel. Typically, MIDI devices such as synthesizer 210 designate MIDI channel 10 for drum instruments that map on to it. However, some MIDI devices do not. The mapping component 208 identifies whether a synthesizer channel 10 in a particular channel group will be designated for drum instruments when instantiated. The configuration information also includes a configuration list such as mapping list 500 that contains the information to allocate and map audio instruction input channels to synthesizer channels.

The mapping and synthesizer component configurations support COM interfaces for reading and loading the configuration data from a file. To instantiate a mapping component 208 or a synthesizer component 210, an application program 202 first instantiates a component using a COM function. The application program then calls a load method for a mapping object or a synthesizer object, and specifies a RIFF file stream. The object parses the RIFF file stream and extracts header information. When it reads individual chunks, it creates synthesizer channel group objects and corresponding channel objects, and mapping channel blocks and corresponding channel objects based on the chunk header information. However, those skilled in the art will recognize that the audio generation systems and the various components described herein are not limited to a COM implementation, or to any other specific programming technique.

Methods Pertaining to an Exemplary Audio Generation System

Figure 6:
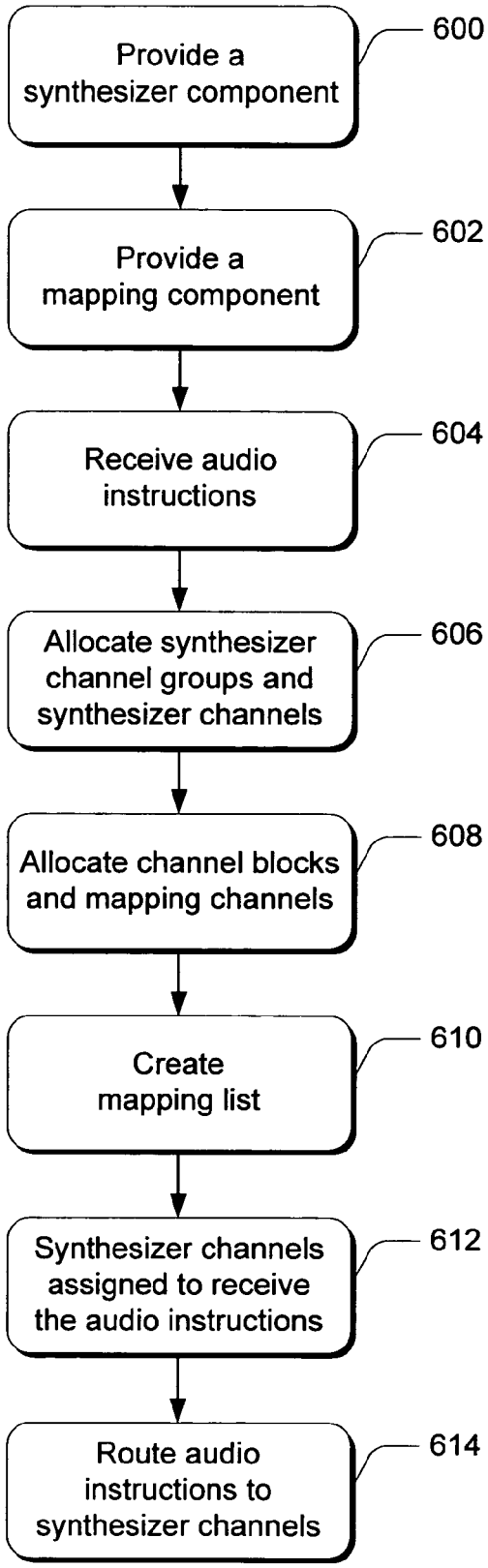
FIG. 6 is a flow diagram of a method for an audio generation system having a mapping component and dynamically allocated synthesizer channels.

FIG. 6 illustrates a method for implementing the invention described herein and refers to components described in FIGS. 2–5 by reference number. The order in which the method is described is not intended to be construed as a limitation. Furthermore, the method can be implemented in any suitable hardware, software, firmware, or combination thereof.

At block 600, a synthesizer component is provided. For example, the synthesizer component can be instantiated from a synthesizer configuration file format (e.g., a RIFF file as described above) as a programming object having an interface that is callable by a software component to receive audio instructions. Alternatively, a synthesizer component can be created from a file representation that is loaded and stored in a synthesizer configuration object that maintains the synthesizer configuration information.

At block 602, a mapping component is provided. For example, the mapping component can be instantiated from a mapping component configuration file format (e.g., a RIFF file) as a programming object having an interface that is callable by a software component to route audio instructions to a synthesizer component. Alternatively, a mapping component can be created from a file representation that is loaded and stored in a configuration object that maintains configuration information for a mapping component.

At block 604, audio instructions are received from one or more sources. The audio instructions have instruction channel designations to indicate a routing destination for the audio instructions. For example, the audio instructions are MIDI instructions that have MIDI channel designations. A MIDI channel designation indicates a MIDI channel from a pre-defined range of sixteen channels in accordance with the MIDI standard.

At block 606, synthesizer channel groups are dynamically allocated for the synthesizer component, and each channel group has sixteen synthesizer channels that support the MIDI standard. The synthesizer channel groups are allocated as needed to receive the audio instructions. If the audio instructions have instruction channel designations that designate the same instruction channel, channel groups and synthesizer channels are allocated to receive the audio instructions on different synthesizer channels.

At block 608, channel blocks are dynamically allocated in the mapping component, and each channel block has sixteen mapping channels. The channel blocks are allocated as needed and correspond to the synthesizer channel groups. A mapping channel in a channel block corresponds to a synthesizer channel in a synthesizer channel group. At block 610, a mapping list is created, such as the mapping channel block-to-synthesizer channel group mapping list 500, to indicate which channel block channels correspond to which synthesizer channels.

At block 612, synthesizer channels are assigned to receive the audio instructions corresponding to the respective instruction channel designations. The audio instructions that designate the same instruction channel are assigned to different synthesizer channels. At block 614, the audio instructions are routed to the synthesizer channels in accordance with the instruction channel designations of the audio instructions and the synthesizer channel assignments. The audio instructions are routed to the synthesizer channels via the corresponding mapping channels in the mapping component.

Exemplary Computing System and Environment

Figure 7:
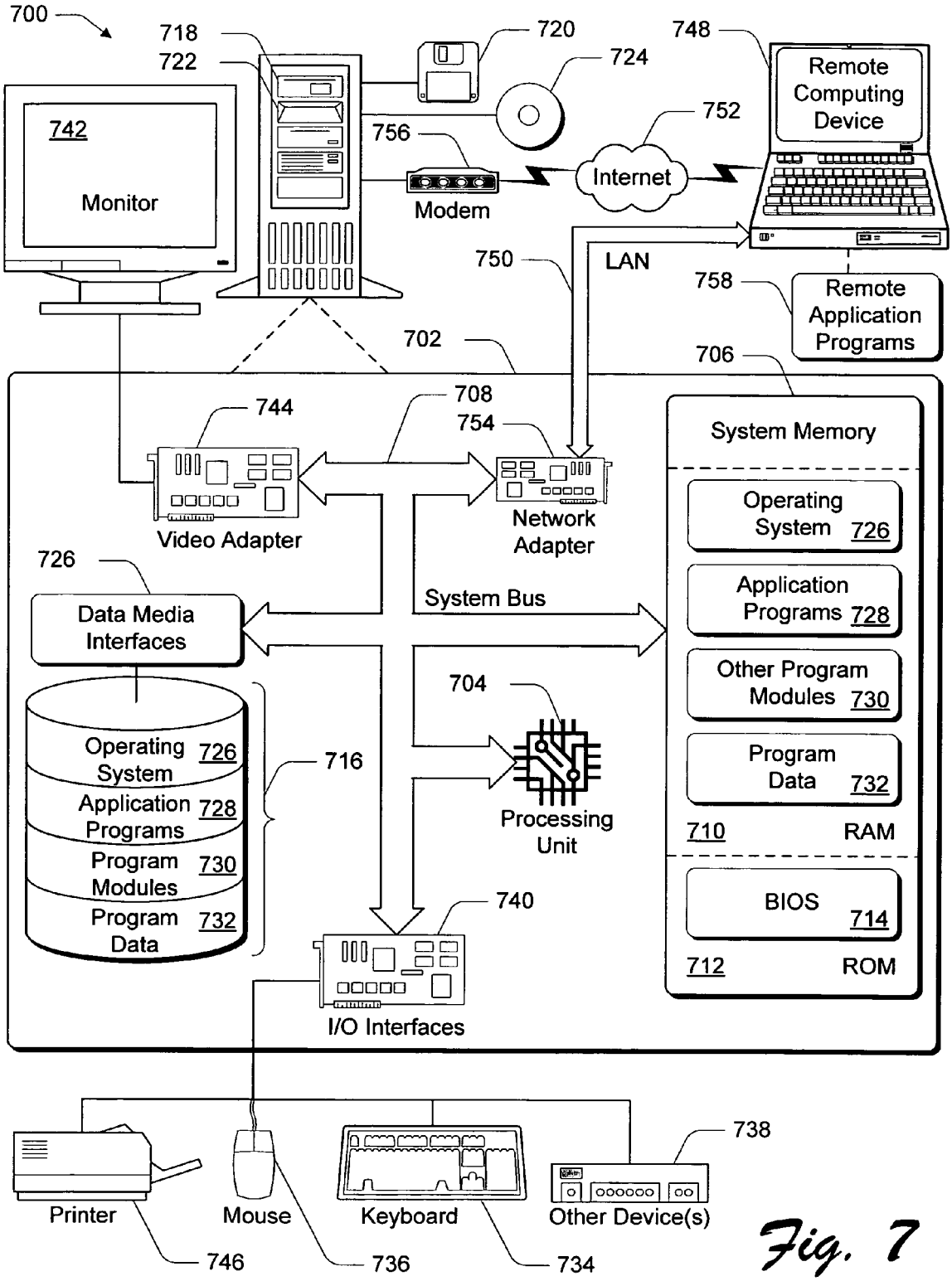
FIG. 7 is a diagram of computing systems, devices, and components in an environment that can be used to implement the invention described herein.

FIG. 7 illustrates an example of a computing environment 700 within which the computer, network, and system architectures described herein can be either fully or partially implemented. Exemplary computing environment 700 is only one example of a computing system and is not intended to suggest any limitation as to the scope of use or functionality of the network architectures. Neither should the computing environment 700 be interpreted as having any dependency or requirement relating to any one or combination of components illustrated in the exemplary computing environment 700.

The computer and network architectures can be implemented with numerous other general purpose or special purpose computing system environments or configurations. Examples of well known computing systems, environments, and/or configurations that may be suitable for use include, but are not limited to, personal computers, server computers, thin clients, thick clients, hand-held or laptop devices, multiprocessor systems, microprocessor-based systems, set top boxes, programmable consumer electronics, network PCs, minicomputers, mainframe computers, gaming consoles, distributed computing environments that include any of the above systems or devices, and the like.

Dynamically allocated synthesizer channels and the mapping component described herein may be described in the general context of computer-executable instructions, such as program modules, being executed by a computer. Generally, program modules include routines, programs, objects, components, data structures, etc. that perform particular tasks or implement particular abstract data types. The invention described herein may also be practiced in distributed computing environments where tasks are performed by remote processing devices that are linked through a communications network. In a distributed computing environment, program modules may be located in both local and remote computer storage media including memory storage devices.

The computing environment 700 includes a general-purpose computing system in the form of a computer 702. The components of computer 702 can include, by are not limited to, one or more processors or processing units 704, a system memory 706, and a system bus 708 that couples various system components including the processor 704 to the system memory 706.

The system bus 708 represents one or more of any of several types of bus structures, including a memory bus or memory controller, a peripheral bus, an accelerated graphics port, and a processor or local bus using any of a variety of bus architectures. By way of example, such architectures can include an Industry Standard Architecture (ISA) bus, a Micro Channel Architecture (MCA) bus, an Enhanced ISA (EISA) bus, a Video Electronics Standards Association (VESA) local bus, and a Peripheral Component Interconnects (PCI) bus also known as a Mezzanine bus.

Computer system 702 typically includes a variety of computer readable media. Such media can be any available media that is accessible by computer 702 and includes both volatile and non-volatile media, removable and non-removable media. The system memory 706 includes computer readable media in the form of volatile memory, such as random access memory (RAM) 710, and/or non-volatile memory, such as read only memory (ROM) 712. A basic input/output system (BIOS) 714, containing the basic routines that help to transfer information between elements within computer 702, such as during start-up, is stored in ROM 712. RAM 710 typically contains data and/or program modules that are immediately accessible to and/or presently operated on by the processing unit 704.

Computer 702 can also include other removable/non-removable, volatile/non-volatile computer storage media. By way of example, FIG. 7 illustrates a hard disk drive 716 for reading from and writing to a non-removable, non-volatile magnetic media (not shown), a magnetic disk drive 718 for reading from and writing to a removable, non-volatile magnetic disk 720 (e.g., a "floppy disk"), and an optical disk drive 722 for reading from and/or writing to a removable, non-volatile optical disk 724 such as a CD-ROM, DVD-ROM, or other optical media. The hard disk drive 716, magnetic disk drive 718, and optical disk drive 722 are each connected to the system bus 708 by one or more data media interfaces 726. Alternatively, the hard disk drive 716, magnetic disk drive 718, and optical disk drive 722 can be connected to the system bus 708 by a SCSI interface (not shown).

The disk drives and their associated computer-readable media provide non-volatile storage of computer readable instructions, data structures, program modules, and other data for computer 702. Although the example illustrates a hard disk 716, a removable magnetic disk 720, and a removable optical disk 724, it is to be appreciated that other types of computer readable media which can store data that is accessible by a computer, such as magnetic cassettes or other magnetic storage devices, flash memory cards, CD-ROM, digital versatile disks (DVD) or other optical storage, random access memories (RAM), read only memories (ROM), electrically erasable programmable read-only memory (EEPROM), and the like, can also be utilized to implement the exemplary computing system and environment.

Any number of program modules can be stored on the hard disk 716, magnetic disk 720, optical disk 724, ROM 712, and/or RAM 710, including by way of example, an operating system 726, one or more application programs 728, other program modules 730, and program data 732. Each of such operating system 726, one or more application programs 728, other program modules 730, and program data 732 (or some combination thereof) may include an embodiment of a synthesizer having dynamically allocated channels and the mapping component described herein.

Computer system 702 can include a variety of computer readable media identified as communication media. Communication media typically embodies computer readable instructions, data structures, program modules, or other data in a modulated data signal such as a carrier wave or other transport mechanism and includes any information delivery media. The term "modulated data signal" means a signal that has one or more of its characteristics set or changed in such a manner as to encode information in the signal. By way of example, and not limitation, communication media includes wired media such as a wired network or direct-wired connection, and wireless media such as acoustic, RF, infrared, and other wireless media. Combinations of any of the above are also included within the scope of computer readable media.

A user can enter commands and information into computer system 702 via input devices such as a keyboard 734 and a pointing device 736 (e.g., a "mouse"). Other input devices 738 (not shown specifically) may include a microphone, joystick, game pad, satellite dish, serial port, scanner, and/or the like. These and other input devices are connected to the processing unit 604 via input/output interfaces 740 that are coupled to the system bus 708, but may be connected by other interface and bus structures, such as a parallel port, game port, or a universal serial bus (USB).

A monitor 742 or other type of display device can also be connected to the system bus 708 via an interface, such as a video adapter 744. In addition to the monitor 742, other output peripheral devices can include components such as speakers (not shown) and a printer 746 which can be connected to computer 702 via the input/output interfaces 740.

Computer 702 can operate in a networked environment using logical connections to one or more remote computers, such as a remote computing device 748. By way of example, the remote computing device 748 can be a personal computer, portable computer, a server, a router, a network computer, a peer device or other common network node, and the like. The remote computing device 748 is illustrated as a portable computer that can include many or all of the elements and features described herein relative to computer system 702.

Logical connections between computer 702 and the remote computer 748 are depicted as a local area network (LAN) 750 and a general wide area network (WAN) 752. Such networking environments are commonplace in offices, enterprise-wide computer networks, intranets, and the Internet. When implemented in a LAN networking environment, the computer 702 is connected to a local network 750 via a network interface or adapter 754. When implemented in a WAN networking environment, the computer 702 typically includes a modem 756 or other means for establishing communications over the wide network 752. The modem 756, which can be internal or external to computer 702, can be connected to the system bus 708 via the input/output interfaces 740 or other appropriate mechanisms. It is to be appreciated that the illustrated network connections are exemplary and that other means of establishing communication link(s) between the computers 702 and 748 can be employed.

In a networked environment, such as that illustrated with computing environment 700, program modules depicted relative to the computer 702, or portions thereof, may be stored in a remote memory storage device. By way of example, remote application programs 758 reside on a memory device of remote computer 748. For purposes of illustration, application programs and other executable program components, such as the operating system, are illustrated herein as discrete blocks, although it is recognized that such programs and components reside at various times in different storage components of the computer system 702, and are executed by the data processor(s) of the computer.

CONCLUSION

The dynamic allocation of MIDI channels for one or more synthesizers allows the synthesizers to receive multiple MIDI channel inputs and avoid overlapping channel inputs. Additionally, the mapping component allows multiple MIDI channel inputs to share available synthesizer channels, thereby conserving system resources.

Although the systems and methods have been described in language specific to structural features and/or methods, it is to be understood that the subject matter in the appended claims is not necessarily limited to the specific features or methods described. Rather, the specific features and methods are disclosed as exemplary implementations of dynamic channel allocation in a synthesizer component.

The invention claimed is:

1. An audio generation system, comprising:

means for receiving audio instructions from multiple sources, the audio instructions having instruction channel designations, wherein some audio instructions from different sources have the same instruction channel designations;

means for assigning synthesizer channels to receive the audio instructions corresponding to the respective instruction channel designations, wherein audio instructions from different sources that designate the same instruction channel are assigned to different synthesizer channels; and means for routing the audio instructions to a particular synthesizer channel in accordance with the instruction channel designations of the audio instructions and the synthesizer channel assignments.

2. An audio generation system as recited in claim 1, wherein the audio instructions from the multiple sources have instruction channel designations that designate instruction channels from a pre-defined range of instruction channels.

3. An audio generation system as recited in claim 1, wherein the audio instructions are MIDI instructions that have instruction channel designations that designate instruction channels from a pre-defined range of instruction channels.

4. An audio generation system as recited in claim 1, wherein the audio instructions are MIDI instructions, the instruction channels are MIDI channels, and the MIDI instructions have MIDI channel designations that designate MIDI channels from a pre-defined range of sixteen MIDI channels.

5. An audio generation system as recited in claim 1, wherein an audio instruction from a particular source designates that any synthesizer channel receiving audio instructions associated with the particular source be processed according to the audio instruction.

6. An audio generation system as recited in claim 1, further comprising means for receiving a broadcast channel audio instruction from a particular source, the broadcast channel designating that any synthesizer channel receiving the audio instruction associated with the broadcast channel be processed according to the broadcast channel audio instruction.

7. An audio generation system as recited in claim 1, wherein the synthesizer channels are defined in channel groups, each channel group having a synthesizer channel corresponding to each possible instruction channel designation.

8. An audio generation system as recited in claim 1, wherein the synthesizer channels are defined in channel groups for a synthesizer, each channel group having a synthesizer channel corresponding to each possible instruction channel designation.

9. An audio generation system as recited in claim 1, wherein the synthesizer channels are defined in channel groups for more than one synthesizer, each channel group having a synthesizer channel corresponding to each possible instruction channel designation.

10. An audio generation system as recited in claim 1, wherein the synthesizer channels are defined in channel groups in more than one synthesizer, each channel group having a synthesizer channel corresponding to each possible instruction channel designation.

11. An audio generation system as recited in claim 1, wherein the means for assigning comprises means for assigning mapping channels to receive the audio instructions, each mapping channel corresponding to a synthesizer channel.

12. An audio generation system as recited in claim 1, wherein the means for assigning comprises means for assigning mapping channels to receive the audio instructions, each mapping channel corresponding to a synthesizer channel, and wherein the means for routing comprises means for routing the audio instructions to the particular synthesizer channel via the corresponding mapping channel.

13. An audio generation system as recited in claim 1, wherein the means for assigning comprises means for assigning mapping channels to receive the audio instructions, the mapping channels defined in channel blocks, and each mapping channel corresponding to a synthesizer channel.

14. An audio generation system as recited in claim 1, wherein the synthesizer channels are defined in channel groups, each channel group having a synthesizer channel corresponding to each possible instruction channel designation, and wherein the means for assigning comprises means for assigning mapping channels to receive the audio instructions, the mapping channels defined in channel blocks that correspond to the channel groups, and each mapping channel corresponding to a synthesizer channel.

15. One or more computer readable media comprising computer executable instructions that, when executed, direct an audio generation system to:

receive audio instructions from multiple sources, the audio instructions having instruction channel designations, wherein some audio instructions from different sources have the same instruction channel designations;

assign synthesizer channels to receive the audio instructions corresponding to the respective instruction channel designations, wherein audio instructions from different sources that designate the same instruction channel are assigned to different synthesizer channels; and route the audio instructions to a particular synthesizer channel in accordance with the instruction channel designations of the audio instructions and the synthesizer channel assignments.

16. One or more computer readable media as recited in claim 15, further comprising computer executable instructions that, when executed, direct the audio generation system to receive a broadcast channel audio instruction from a particular source, the broadcast channel designating that any synthesizer channel receiving the audio instruction associated with the broadcast channel be processed according to the broadcast channel audio instruction.

17. One or more computer readable media as recited in claim 15, further comprising computer executable instructions that, when executed, direct the audio generation system to assign mapping channels to receive the audio instructions, each mapping channel corresponding to a synthesizer channel.

18. One or more computer readable media as recited in claim 15, further comprising computer executable instructions that, when executed, direct the audio generation system to assign mapping channels to receive the audio instructions, each mapping channel corresponding to a synthesizer channel, and route the audio instructions to the particular synthesizer channel via the corresponding mapping channel.

19. One or more computer readable media as recited in claim 15, further comprising computer executable instructions that, when executed, direct the audio generation system to assign mapping channels to receive the audio instructions, the mapping channels defined in channel blocks, and each mapping channel corresponding to a synthesizer channel.

20. An audio generation system, comprising:

means for receiving audio instructions from multiple sources, the audio instructions having instruction channel designations that designate instruction channels from a limited range of instruction channels, wherein some audio instructions from different sources have the same instruction channel designations;

means for defining channel groups having synthesizer channels, each channel group having a synthesizer channel corresponding to each possible instruction channel designation;

means for assigning the synthesizer channels to receive the audio instructions corresponding to the respective instruction channel designations, wherein audio instructions from different sources that designate the same instruction channel are assigned to a synthesizer channel in different channel groups; and means for routing the audio instructions to a particular synthesizer channel in accordance with the instruction channel designations of the audio instructions and the synthesizer channel assignments.

21. An audio generation system as recited in claim 20, wherein the audio instructions are MIDI instructions, the instruction channels are MIDI channels, and the MIDI instructions have MIDI channel designations that designate MIDI channels from a pre-defined range of sixteen MIDI channels.

22. An audio generation system as recited in claim 20, wherein the means for defining comprises means for allocating the channel groups in a synthesizer.

23. An audio generation system as recited in claim 20, wherein the means for defining comprises means for allocating the channel groups for more than one synthesizer.

24. An audio generation system as recited in claim 20, wherein the means for defining comprises means for allocating the channel groups in more than one synthesizer.

25. An audio generation system as recited in claim 20, wherein the means for assigning comprises means for assigning mapping channels to receive the audio instructions, each mapping channel corresponding to a synthesizer channel.

26. An audio generation system as recited in claim 20, wherein the means for assigning comprises means for assigning mapping channels to receive the audio instructions, each mapping channel corresponding to a synthesizer channel, and wherein the means for routing comprises means for routing the audio instructions to the particular synthesizer channel via the corresponding mapping channel.

27. An audio generation system as recited in claim 20, wherein the means for assigning comprises means for assigning mapping channels to receive the audio instructions, the mapping channels defined in channel blocks, and each mapping channel corresponding to a synthesizer channel.

28. An audio generation system as recited in claim 20, wherein the means for assigning comprises means for assigning mapping channels to receive the audio instructions, the mapping channels defined in channel blocks that correspond to the channel groups, and each mapping channel corresponding to a synthesizer channel.

29. An audio generation system as recited in claim 20, wherein the means for assigning comprises means for assigning mapping channels to receive the audio instructions, the mapping channels defined in channel blocks that correspond to the channel groups in a synthesizer, and each mapping channel corresponding to a synthesizer channel.

30. An audio generation system as recited in claim 20, wherein the means for assigning comprises means for assigning mapping channels to receive the audio instructions, the mapping channels defined in channel blocks that correspond to the channel groups in more than one synthesizer, and each mapping channel corresponding to a synthesizer channel.

31. An audio generation system as recited in claim 20, wherein the means for defining comprises means for allocating the channel groups in a synthesizer, and wherein the means for assigning comprises means for assigning mapping channels to receive the audio instructions, each mapping channel corresponding to a synthesizer channel in a channel group in the synthesizer.

32. An audio generation system as recited in claim 20, wherein the means for defining comprises means for allocating the channel groups in multiple synthesizers, and wherein the means for assigning comprises means for assigning mapping channels to receive the audio instructions, each mapping channel corresponding to a synthesizer channel in a channel group in one of the synthesizers.

33. One or more computer readable media comprising computer executable instructions that, when executed, direct an audio generation system to:

receive audio instructions from multiple sources, the audio instructions having instruction channel designations that designate instruction channels from a limited range of instruction channels, wherein some audio instructions from different sources have the same instruction channel designations;

define channel groups having synthesizer channels, each channel group having a synthesizer channel corresponding to each possible instruction channel designation;

assign the synthesizer channels to receive the audio instructions corresponding to the respective instruction channel designations, wherein audio instructions from different sources that designate the same instruction channel are assigned to a synthesizer channel in different channel groups; and route the audio instructions to a particular synthesizer channel in accordance with the instruction channel designations of the audio instructions and the synthesizer channel assignments.

34. One or more computer readable media as recited in claim 33, further comprising computer executable instructions that, when executed, direct the audio generation system to allocate the channel groups in a synthesizer.

35. One or more computer readable media as recited in claim 33, further comprising computer executable instructions that, when executed, direct the audio generation system to allocate the channel groups for more than one synthesizer.

36. One or more computer readable media as recited in claim 33, further comprising computer executable instructions that, when executed, direct the audio generation system to allocate the channel groups in more than one synthesizer.

37. One or more computer readable media as recited in claim 33, further comprising computer executable instructions that, when executed, direct the audio generation system to assign mapping channels to receive the audio instructions, each mapping channel corresponding to a synthesizer channel.

38. One or more computer readable media as recited in claim 33, further comprising computer executable instructions that, when executed, direct the audio generation system to assign mapping channels to receive the audio instructions, each mapping channel corresponding to a synthesizer channel, and to route the audio instructions to the particular synthesizer channel via the corresponding mapping channel.

39. One or more computer readable media as recited in claim 33, further comprising computer executable instructions that, when executed, direct the audio generation system to assign mapping channels to receive the audio instructions, the mapping channels defined in channel blocks, and each mapping channel corresponding to a synthesizer channel.

40. One or more computer readable media as recited in claim 33, further comprising computer executable instructions that, when executed, direct the audio generation system to assign mapping channels to receive the audio instructions, the mapping channels defined in channel blocks that correspond to the channel groups, and each mapping channel corresponding to a synthesizer channel.

41. One or more computer readable media as recited in claim 33, further comprising computer executable instructions that, when executed, direct the audio generation system to assign mapping channels to receive the audio instructions, the mapping channels defined in channel blocks that correspond to the channel groups in a synthesizer, and each mapping channel corresponding to a synthesizer channel.

42. One or more computer readable media as recited in claim 33, further comprising computer executable instructions that, when executed, direct the audio generation system to assign mapping channels to receive the audio instructions, the mapping channels defined in channel blocks that correspond to the channel groups in more than one synthesizer, and each mapping channel corresponding to a synthesizer channel.

43. One or more computer readable media as recited in claim 33, further comprising computer executable instructions that, when executed, direct the audio generation system to allocate the channel groups in a synthesizer, and assign mapping channels to receive the audio instructions, each mapping channel corresponding to a synthesizer channel in a channel group in the synthesizer.

44. One or more computer readable media as recited in claim 33, further comprising computer executable instructions that, when executed, direct the audio generation system to allocate the channel groups in multiple synthesizers, and assign mapping channels to receive the audio instructions, each mapping channel corresponding to a synthesizer channel in a channel group in one of the synthesizers.

45. An audio generation system, comprising:

means for receiving audio instructions from multiple sources, the audio instructions having instruction channel designations that designate instruction channels from a limited range of instruction channels, wherein some audio instructions from different sources have the same instruction channel designations;

means for defining channel groups having synthesizer channels, each channel group having a synthesizer channel corresponding to each possible instruction channel designation;

means for defining channel blocks having mapping channels, each channel block having a mapping channel corresponding to a synthesizer channel;

means for assigning the mapping channels to receive the audio instructions corresponding to the respective instruction channel designations, wherein audio instructions from different sources that designate the same instruction channel are assigned to a different mapping channel that corresponds to a synthesizer channel in different channel groups; and means for routing the audio instructions to a particular synthesizer channel in accordance with the instruction channel designations of the audio instructions and the mapping channel assignments.

46. An audio generation system as recited in claim 45, wherein the audio instructions are MIDI instructions, the instruction channels are MIDI channels, and the MIDI instructions have MIDI channel designations that designate MIDI channels from a pre-defined range of sixteen MIDI channels.

47. An audio generation system as recited in claim 45, wherein the means for defining channel groups comprises means for allocating the channel groups in a synthesizer.

48. An audio generation system as recited in claim 45, wherein the means for defining channel groups comprises means for allocating the channel groups in more than one synthesizer.

49. An audio generation system as recited in claim 45, wherein the means for defining channel groups comprises means for allocating the channel groups for more than one synthesizer.

50. One or more computer readable media comprising computer executable instructions that, when executed, direct an audio generation system to:

receive audio instructions from multiple sources, the audio instructions having instruction channel designations that designate instruction channels from a limited range of instruction channels, wherein some audio instructions from different sources have the same instruction channel designations;

define channel groups having synthesizer channels, each channel group having a synthesizer channel corresponding to each possible instruction channel designation;

define channel blocks having mapping channels, each channel block having a mapping channel corresponding to a synthesizer channel;

assign the mapping channels to receive the audio instructions corresponding to the respective instruction channel designations, wherein audio instructions from different sources that designate the same instruction channel are assigned to a different mapping channel that corresponds to a synthesizer channel in different channel groups; and route the audio instructions to a particular synthesizer channel in accordance with the instruction channel designations of the audio instructions and the mapping channel assignments.

51. One or more computer readable media as recited in claim 50, further comprising computer executable instructions that, when executed, direct the audio generation system to allocate the channel groups in a synthesizer.

52. One or more computer readable media as recited in claim 50, further comprising computer executable instructions that, when executed, direct the audio generation system to allocate the channel groups in more than one synthesizer.

53. One or more computer readable media as recited in claim 50, further comprising computer executable instructions that, when executed, direct the audio generation system to allocate the channel groups for more than one synthesizer.

* * * * *

UNITED STATES PATENT AND TRADEMARK OFFICE

CERTIFICATE OF CORRECTION

PATENT NO. : 7,005,572 B2
APPLICATION NO. : 10/974189
DATED : February 28, 2006
INVENTOR(S) : Todor J. Fay It is certified that error appears in the above-identified patent and that said Letters Patent is hereby corrected as shown below:

On page 2, item (56), under "Other Publications", in column 1, line 8, delete "et al.,"Interactive" and insert -- et al., "Interactive --, therefor.

On page 2, item (56), under "Other Publications", in column 1, line 17, delete "et al.,"A" and insert -- et al., "A --, therefor.

In column 8, line 26, insert -- channel block identifier 504, a channel block channel identifier 506, a corresponding synthesizer component identifier 508, a channel group identifier 510, a channel group channel identifier 512. Thus, each mapping 502 -- before "associates".

Signed and Sealed this

Twenty-first Day of July, 2009

John Doll

JOHN DOLL
*Acting Director of the United States Patent and Trademark Office*